United States Patent [19]

Parker et al.

[11] 4,161,296

[45] Jul. 17, 1979

[54] GRANULATOR WITH FORCED FEED ASSEMBLY

[76] Inventors: Frank Parker; Leslie M. Parker, both of Old Brandon Rd., Hillsboro, Tex. 76645

[21] Appl. No.: 914,037

[22] Filed: Jun. 9, 1978

[51] Int. Cl.[2] ..... B02C 23/00

[52] U.S. Cl. ..... 241/152 A; 241/157; 241/222; 241/235

[58] Field of Search ..... 241/152 R, 152 A, 155, 241/157, 158, 222, 224, 235, 221, 225

[56] References Cited

U.S. PATENT DOCUMENTS

| | | | |
|---|---|---|---|
| 1,724,072 | 8/1929 | Daniels | 241/152 A |
| 1,776,593 | 9/1930 | Meyer | 241/152 A |
| 3,217,765 | 11/1965 | Anderson | 241/225 X |
| 3,596,842 | 8/1971 | Barber | 241/222 |

*Primary Examiner*—Richard B. Lazarus
*Attorney, Agent, or Firm*—James E. Bradley

[57] ABSTRACT

An apparatus for granulating articles into particles for reuse, having a force feed mechanism that urges the articles into the grinder chamber. The apparatus has a chute for inserting articles, and the grinder chamber encloses rotor knives that are rotated past stationary knives. The force feed assembly is mounted above the grinder chamber and includes a rotating shaft driven by a motor separate from the grinder assembly motors. A series of plates are mounted to the shaft at intervals. The plates have teeth on the edge for grabbing and tearing articles. Webs are mounted between the plates for pushing the articles into the grinder chamber.

15 Claims, 6 Drawing Figures

GRANULATOR WITH FORCED FEED ASSEMBLY

BACKGROUND OF THE INVENTION

1. Field of the Invention

This invention relates in general to grinding machinery and in particular to a force feed assembly for a granulator of articles.

2. Description of the Prior Art

In manufacturing plastic articles, such as drinking cups, hamburger cartons, liquid cleaning solution bottles, and the like, a certain percentage will have defects that require them to be rejected. In large high-speed plants, the number of rejects adds up to a large amount of scrap. Many plants have devices for grinding or granulating the rejected articles, reducing them into particles small enough that allows the particles to be converted into raw material for reuse in the forming process. Granulators are also used for metal objects, such as aluminum cans and plastic coated copper wire.

Normally, granulators have a chute with an entry for inserting the articles, and a grinder chamber mounted below. The grinder chamber includes a set of rotor knives that rotate past a stationary bed knife to cut the articles. A perforated screen is mounted below, to allow the particles to fall into a collection chamber when they are cut into small enough pieces. The articles are gravity fed into the grinder chamber. Applicants do not know of any type of feeder mechanism used in this type of granulator for urging articles into the grinder chamber.

One type of granulator uses feed rollers to urge the material into the grinder chamber. However, this type of granulator does not process three dimensional articles, rather granulates thin sheets of plastic scrap material. The feed rollers comprise a pair of rotating pipes, each pipe having small tubes welded to the pipe surface parallel to its axis for urging the sheet material into the grinder chamber. This type of feeder mechanism would not aid in urging light, hollow, three dimensional articles into the grinder chamber.

Various patents for grinding materials disclose feeder mechanisms, including U.S. Pat. Nos. 1,187,242, 416,204 and 3,310,086.

SUMMARY OF THE INVENTION

It is a general object of this invention to provide an improved apparatus for granulating articles.

It is a further object of this invention to provide an improved granulator for granulating articles that has a force feeding assembly for urging the articles into the grinder chamber.

In accordance with these objects, a force feeding mechanism is provided with the granulator, that is adapted to grab articles, tear, crush and push them into the grinder chamber. The force feeder mechanism includes a chamber mounted above the grinder chamber. A shaft is mounted in the chamber and is connected to drive means for rotating it. A series of plates are mounted to the shaft at intervals. Each plate has teeth on its edge for grabbing and tearing into the articles. Webs are mounted between the plates for pushing the articles into the cutting chamber.

In one embodiment, which is used with large capacity granulators, two spaced apart shafts are used. The shafts are rotated in opposite directions to pull the articles in between the plates and webs. The plates are preferably sprockets, and are smaller in diameter on one shaft than on the other.

In a second embodiment, for use in smaller capacity granulators, only a single shaft is used. The plates comprise sprockets in which two parallel and equal segments have been removed.

DESCRIPTION OF THE PREFERRED EMBODIMENT

Figure 1:
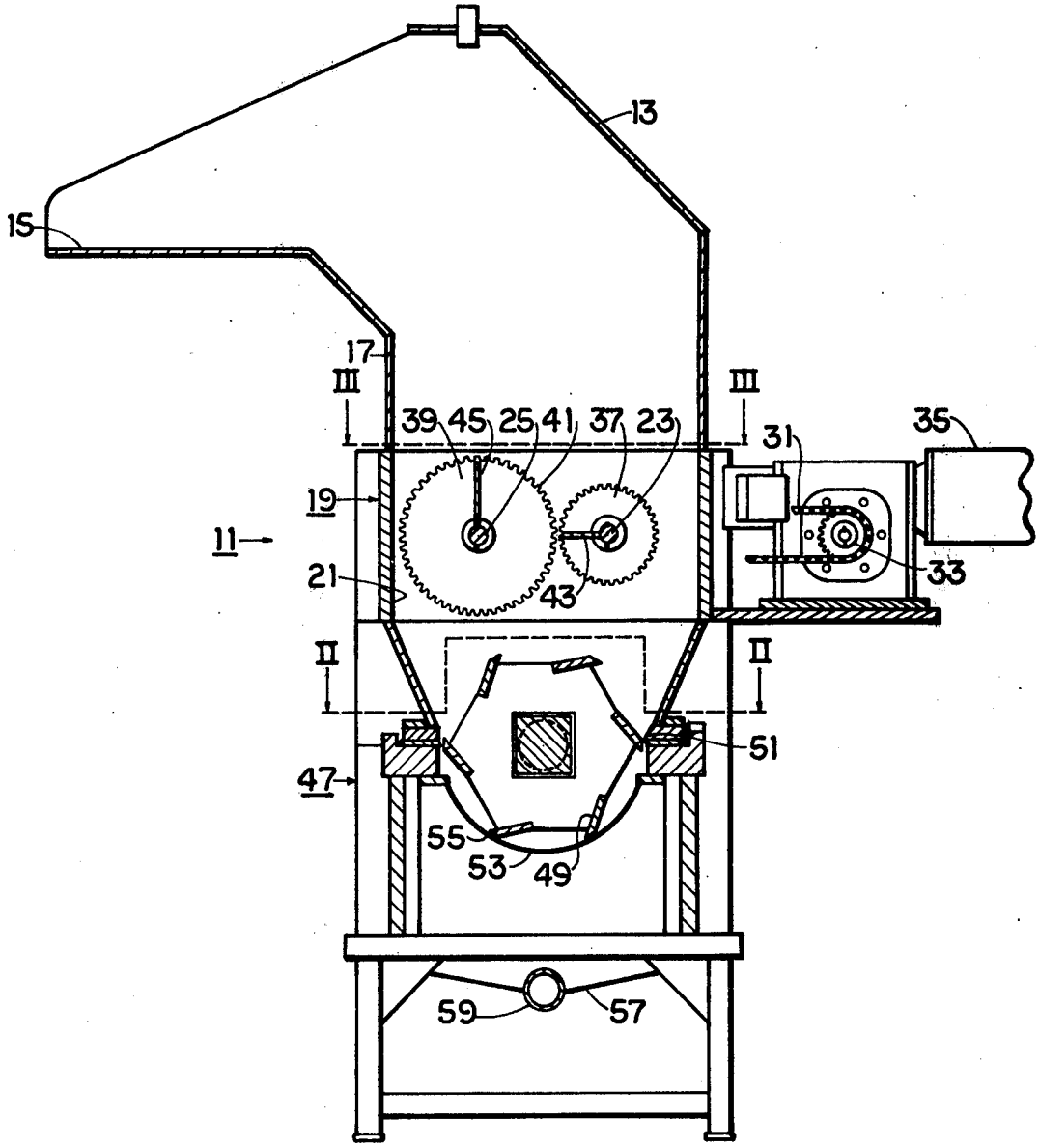
FIG. 1 is a partial vertical sectional view of a granulator constructed in accordance with this invention.

Referring to FIG. 1, the granulator 11 has a chute 13 with an entry 15 for inserting articles to be granulated. Entry 15 opens to the side, allowing articles to be placed on a horizontal portion, then pushed into a vertical, rectangular portion 17 of the chute.

Figure 3:
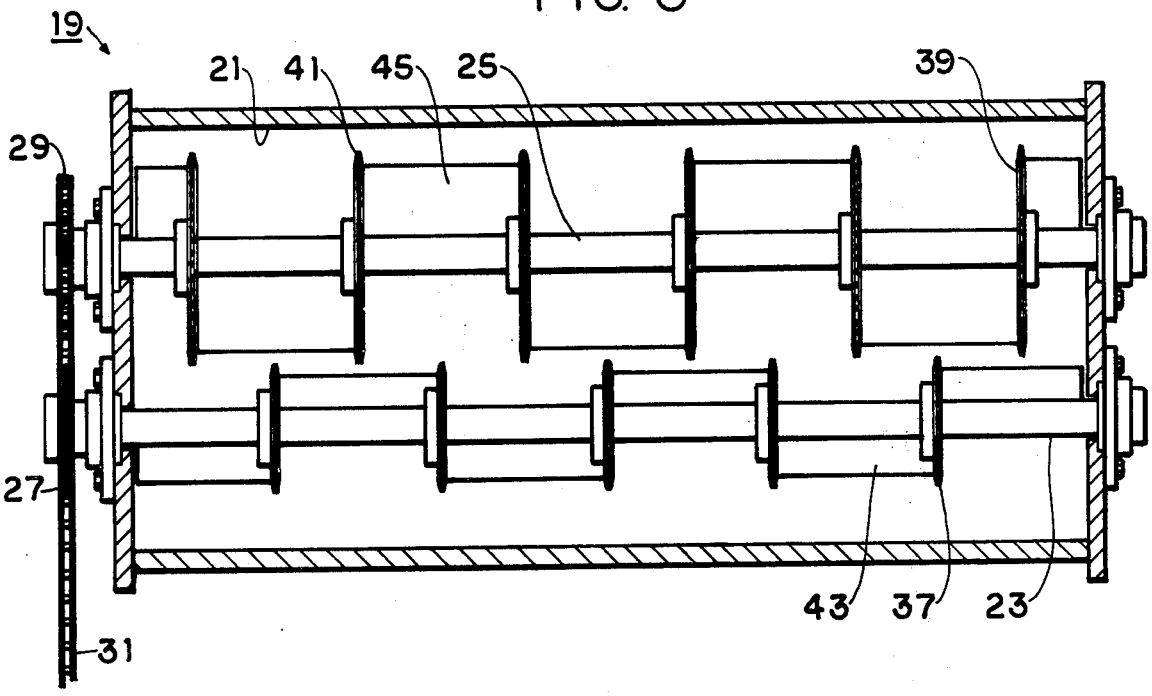
FIG. 3 is a cross-sectional view of the granulator of FIG. 1 taken along the line III—III, and with the force feeding assembly in a different position of rotation.

A force feeding assembly 19 is mounted in the chute vertical portion 17. Referring also to FIG. 3, the force feeding assembly 19 includes a rectangular chamber 21 with four vertical walls. A pair of straight shafts 23, 25 extend horizontally across the chamber 21. Shafts 23, 25 are mounted to the wall so as to be rotatable, but are linearly immovable. They cannot move up, down, or expand farther from each other. Shafts 23, 25 are parallel with each other and lie in the same horizontal plane.

Referring to FIG. 3, driven sprockets 27, 29 are mounted to the ends of shafts 23, 25, respectively. A single chain 31 extends around sprocket 29, under sprocket 27, and around a drive sprocket 33 of an electrical motor 35 (FIG. 1). The electrical motor 35, chain 31, and sprockets 27, 29 and 33 serve as drive means for rotating the shafts in opposite directions. Driven sprocket 29 is larger than driven sprocket 27, thus shaft 23 rotates faster than shaft 25.

A plurality of plates or sprockets 37, 39 are rigidly mounted along shafts 23, 25, respectively, for rotation therewith. Sprockets 37, 39 are perpendicular to shafts 23, 25. Sprockets 37, 39 are circular, conventional, chain drive sprockets, with drive teeth 41 extending completely around the edge or perimeter. Sprockets 39 are larger in diameter than sprockets 37. Sprockets 37 are spaced apart the same distances as sprockets 39, but are offset so that the sprockets on one shaft are centered between sprockets on the opposite shaft. Consequently, none of the sprockets are in the same vertical plane.

Webs 43, 45 extend between each sprocket 37, 39 on each shaft 23, 25, and also extend from the outer sprockets on each shaft to a point near the walls of feeder chamber 21. Webs 43, 45 are rectangular, thin plates of metal welded to the shafts 23, 25 and the sides of the sprockets 37, 39. Webs 43, 45 extend from the shafts to a point even with the base of the teeth 41. A single web is mounted between each pair of sprockets, and on each shaft, the webs alternate 180°. Consequently, on a single shaft, all of the webs will be in the same plane, although half of them will be 180° out of phase with the other half.

With different size driven sprockets 27, 29, as shown, the angles at which the webs 43 lie with respect to webs 45 continuously vary. For example, in FIG. 1, the webs 43 are at 90° with respect to webs 45, and in FIG. 3, webs 43 are in phase with webs 45. If the same size driven sprockets 27, 29 are used, the webs will be in fixed positions relative to each other. The fixed positions can be set to be in phase for small articles to any position up to 90° out of phase for large articles. Shafts 23, 25 are spaced apart a distance slightly greater than the sum of the radii of sprockets 37 and 39, so that teeth 41 do not contact the webs on the opposite shaft.

A conventional grinder chamber 47 is located directly below the force feeding assembly 19. Grinder chamber 47 includes a set of rotor knives 49 that are mounted in a cylindrical array, horizontal and parallel with shafts 23, 25. Rotor knives 49 are rotated by a belt drive assembly 50 and electrical motors (not shown) on each side. Consequently, the rotor knives are driven independently of the force feeding assembly, however, the separate drive means cooperate to avoid overloading, as will be described later. The rotor knives 49 are rotated past the stationary bed knives 51. The rotor knives 49 are mounted sufficiently close to the sprockets 37, 39 so that they will engage a crushed article as it is being pushed down and released by the force feeding assembly.

A semi-cylindrical perforated screen 53 is mounted directly below rotor knives 49, and spaced slightly from the knives 49. Screen 53 has a plurality of apertures 55 that allow the particles to fall through, when small enough. A collection chamber 57 is mounted below grinder chamber 47. A conduit 59, located at the bottom of chamber 57, leads to a vacuum source for drawing the particles out for reuse.

The granulator has a monitor system (not shown) that senses the electrical current drawn by the drive motors for the rotor knives 49. If an overload occurs, such as due to having too much material in the grinder chamber, the force feed motor 35 will stop until the overload has been cleared by the rotor drive motors. A time delay circuit assures that the overload is not merely momentary, before stopping the force feed motor 35.

In operation, articles are placed in the entry 15 and pushed over the vertical portion 17. As they stack up over the force feed assembly, the teeth 41 of the sprockets 37, 39 grab and tear them. The faster rotating sprockets 37 tend to push the articles into the slower rotating sprockets 39, increasing the tearing action. Webs 43, 45 push the articles downward, crushing and directly forcing them into the grinder chamber 47. Rotor knives 49 push the crushed articles against the bed knives 51, cutting them into particles. Particles that are small enough fall through apertures 55 in screen 53. Larger pieces are brought upward again by the rotor knives 49 and again cut.

The force feeding assembly has increased significantly the amount of material that a granulator can process. In one successful embodiment for granulating plastic articles, the force feeding chamber 21 is approximately 51 inches long, 22 inches wide, with five smaller sprockets 37 and six larger sprockets 39. The sprockets on each shaft are spaced apart from each other about 8½ inches. Sprockets 37 have twenty-eight teeth and are 7 inches in diameter, while sprockets 39 have forty-five teeth and are about 11 inches in diameter. Sprockets 37 are spaced from the chamber walls approximately 3 inches, and sprockets 39 are spaced from the chamber walls approximately 1 inch. Shaft 23 is driven by a 6 inch diameter sprocket, and shaft 25 by an 8⅝ inch diameter sprocket. The bottom of larger sprocket 39 is about 2½ inches away from the path of revolution of rotor knives 49.

These dimensions will vary not only on the capacity of the machine, but also the product to be granulated. For example, denser plastic material may require more tearing action before entering the grinder chamber than lighter materials. This can be achieved by increasing the shaft rotation speed of the smaller sprocket shaft 23 with respect to the shaft 25.

Figure 2:
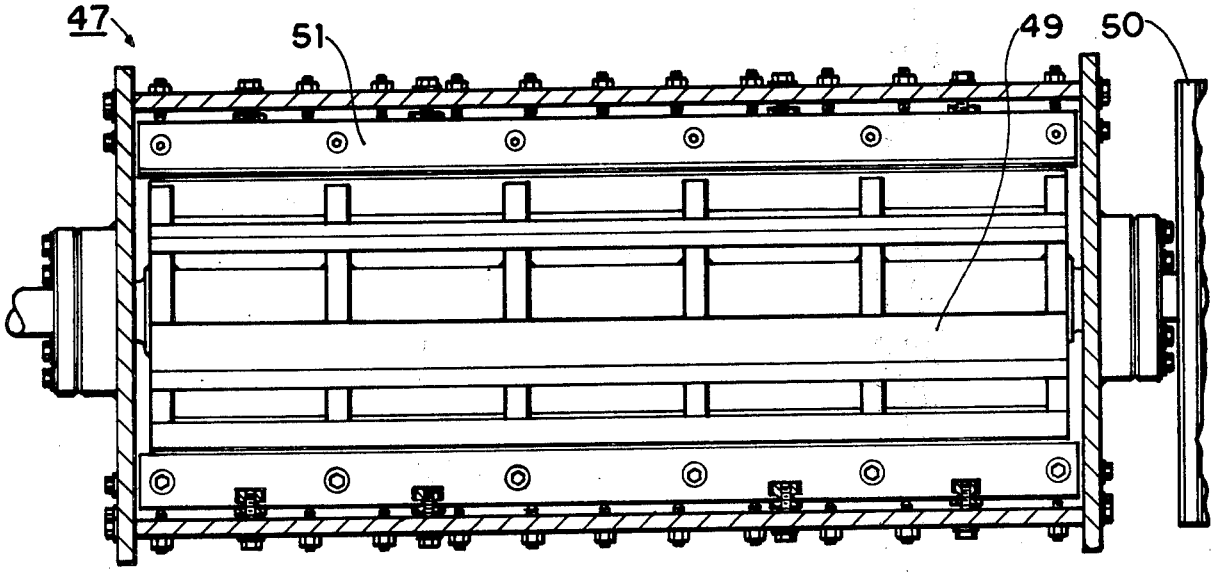
FIG. 2 is a cross-sectional view of the granulator of FIG. 1, taken along the line II—II.
Figure 4:
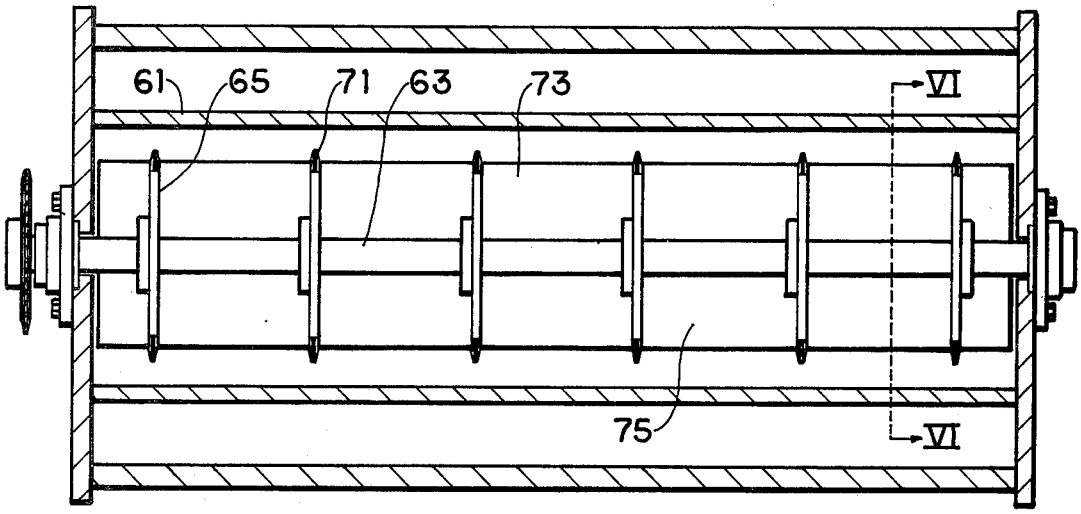
FIG. 4 is a top plan view of an alternate embodiment of a force feeding assembly.
Figure 5:
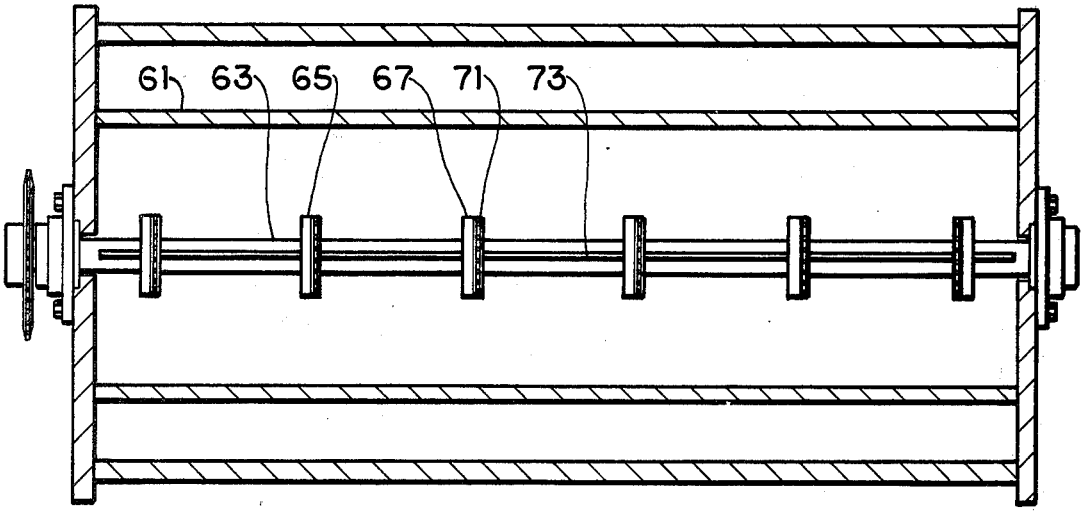
FIG. 5 is a top plan view of the force feeding assembly of FIG. 4, with the shaft shown rotated 90° from the position shown in FIG. 4.
Figure 6:
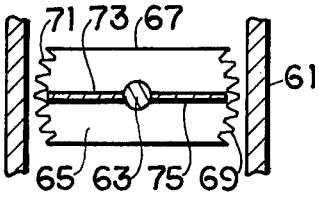
FIG. 6 is a cross-sectional view of the force feeding assembly of FIG. 4, taken along the line VI—VI.

An alternate embodiment is illustrated in FIGS. 4–6. This embodiment is for smaller capacity machines than the embodiment of FIGS. 1–3. It has a chute and grinder chamber similar to the embodiment of FIGS. 1–3, thus is not shown. The force feeding assembly includes a rectangular chamber with four vertical walls. A single shaft 63 is mounted between two of the walls, horizontal and parallel with the rotor knives. A shaft 63 is driven by an electrical motor independent of the rotor drive means.

Six plates 65 are mounted at equal distances along shaft 63 for rotation therewith. Each plate 65, as shown in FIGS. 5 and 6, is formed from a circular sprocket. Two parallel and equal segments have been removed, defining a plate with two parallel straight edges 67 and two arcuate edges 69. During construction, each straight edge 67 is cut at approximately ½ the radius from the center of a circular sprocket. Teeth 71 are formed on the arcuate sides 69.

Two webs 73, 75 are formed between each plate 65 and between the end plates and chamber 61 walls. Webs 73, 75 are 180° out of phase with each other, thus lie in a single plane. Webs 73, 75 extend from the shaft to the base of the teeth 71 and intersect the arcuate surfaces 69 at their centers.

In operation, teeth 71 grab and tear at the articles, which are crushed and pushed into the grinder chamber by the webs. The removed segments from the plates 65 further aid in gripping and pushing the materials downward.

It should be apparent that an invention having significant improvements has been provided. The force feeding assembly significantly increases the quantity of material that a granulator can process. The combination of sprocket teeth and webs effectively tear, push, and crush articles into the grinder chamber, particularly light and hollow articles.

While the invention has been shown in only two of its forms, it should be apparent to those skilled in the art that it is not so limited but is susceptible to various changes and modifications without departing from the spirit thereof. For example, for grinding plastic pipe and large bulky parts, the sprocket shafts could be mounted perpendicular to the rotor knives. Also, an additional force feed assembly could be mounted ahead of the force feed assembly. In addition, the force feed assembly could be mounted horizontally with the grinder chamber.

What is claimed is:

1. In an apparatus for granulating articles into particles of the type having a chute with an entry for insertion of the articles to be granulated, and a grinder chamber in communication with the chute, the grinder chamber enclosing a plurality of rotor knives that are rotated past a stationary knife for cutting the articles and a perforated screen mounted below the rotor knives having apertures that allow the particles to pass through for collection, a force feeding means for urging the articles into the grinder chamber, comprising:

a force feeding chamber located between the grinder chamber and the entry of the chute;

a shaft extending across the force feeding chamber;

drive means for rotating the shaft;

a pair of plates mounted on the shaft for rotating therewith and spaced apart a selected distance; each plate having a plurality of teeth formed on at least a portion of its edge for grabbing and tearing the articles; and a web mounted between the pair of plates for crushing and pushing the articles into the grinder chamber.

2. The granulator according to claim 1 wherein the webs are perpendicular to the plates and extend substantially from the shaft to the base of the teeth of the plates.

3. The granulator according to claim 1 wherein the shaft is parallel with the rotor knives.

4. The granulator according to claim 1 wherein the drive means drives the shaft independent of the rotor knives.

5. In an apparatus for granulating articles into particles of the type having a chute with an entry for insertion of the articles to be granulated, and a grinder chamber in communication with the chute and enclosing a plurality of rotor knives that are rotated past a stationary knife for cutting the articles and a perforated screen mounted below the rotor knives having apertures that allow the particles to fall through for collection, a force feeding means for urging the articles into the grinder chamber, comprising:

a force feeding chamber located between the grinder chamber and the entry of the chute;

a pair of shafts mounted across the force feeding chamber, the shafts being parallel with each other;

drive means for rotating the shafts in opposite directions to each other;

a pair of plates mounted on each of the shafts for rotation therewith, each plate having a plurality of teeth formed on at least a portion of its edge for grabbing and tearing the articles; and a web mounted between the pair of plates on each shaft for pushing the articles into the grinder chamber;

the plates being spaced apart on the shafts at intervals selected so that the plates on one shaft are not in the same vertical planes as the plates on the other shaft, and the shafts being spaced apart sufficiently so that the plates on one shaft do not contact the webs on the other shaft.

6. The granulator according to claim 5 wherein the plates are circular sprockets with teeth formed on the entire edge.

7. The granulator according to claim 6 wherein the plates on one shaft are larger in diameter than the plates on the other shaft.

8. The granulator according to claim 5 wherein the drive means rotates the shafts at different speeds.

9. The granulator according to claim 5 wherein the shafts are linearly immovable.

10. In an apparatus for granulating articles into particles of the type having a chute with an entry for insertion of the articles to be granulated, and a grinder chamber in communication with the chute and enclosing a plurality of rotor knives that are rotated past a stationary knife for cutting the articles and a perforated screen mounted below the rotor knives having apertures that allow the particles to fall through for collection, a force feeding means for urging the articles into the grinder chamber, comprising:

a force feeding chamber located between the grinder chamber and the entry of the chute;

a pair of straight shafts mounted in the force feeding chamber so as to be rotatable but linearly immovable; the shafts being parallel with each other, lying in the same horizontal plane, and being parallel with the rotor knives;

drive means for rotating the shafts in opposite directions to each other independent of the rotation of the rotor knives and at different speeds from each other;

a plurality of sprockets mounted vertically on each shaft for rotation therewith, each sprocket having a plurality of teeth formed on the edge for grabbing and tearing the articles; all of the sprockets on the same shaft being equal in diameter, but the sprockets on one of the shafts being greater in diameter than the sprockets on the other shaft; and a web mounted between each pair of sprockets perpendicular to them; each web extending substantially from the shaft to the base of the teeth of the sprocket;

the shafts being spaced apart slightly greater than the sum of the radii of the sprockets of the two shafts so that the teeth do not contact the webs of the opposite shaft;

the sprockets on one of the shafts being spaced apart from each other the same distance as the sprockets on the other shaft, but offset so that a sprocket on one shaft is centered between two sprockets on the opposite shaft.

11. The granulator according to claim 10 wherein the relative position of the webs on one shaft continuously varies from in phase to 90° out pf phase with the webs of the other shaft.

12. The granulator according to claim 10 wherein on each shaft, the webs are alternated 180° from each other.

13. In an apparatus for granulating articles into particles of the type having a chute with an entry for insertion of the articles to be granulated, and a grinder chamber in communication with the chute and enclosing a plurality of rotor knives that are rotated past a stationary knife for cutting the articles and a perforated screen mounted below the rotor knives having apertures that allow the particles to fall through for collection, a force feeding means for urging the articles into the grinder chamber, comprising:

a force feeding chamber located between the grinder chamber and the entry of the chute;

a single straight shaft mounted in the force feeding chamber; the shaft being parallel with the rotor knives;

drive means for rotating the shaft;

a pair of plates mounted on the shaft for rotation therewith, each plate being formed from a circular sprocket in which a segment has been removed, the perimeter defining a straight edge and an arcuate edge; each plate having a plurality of teeth on its arcuate edge for gripping and tearing the articles; and a web mounted between the plates for pushing the articles into the grinder chamber.

14. The granulator according to claim 13 wherein two webs are located between the pair of plates, each extending from the shaft on opposite sides and 180° apart.

15. In an apparatus for granulating articles into particles of the type having a chute with an entry for insertion of the articles to be granulated, and a grinder chamber in communication with the chute and enclosing a plurality of rotor knives that are rotated past a stationary knife for cutting the articles and a perforated screen mounted below the rotor knives having apertures that allow the particles to fall through for collection, a force feeding means for urging the articles into the grinder chamber, comprising:

a force feeding chamber located between the grinder chamber and the entry of the chute;

a single straight shaft mounted in the force feeding chamber; the shaft being parallel with the rotor knives;

drive means for rotating the shaft;

at least two plates mounted on the shaft for rotation therewith, each plate being formed from a circular sprocket in which two parallel and equal segments have been removed, the parimeter defining two straight parallel edges separated by two arcuate edges; each plate having a plurality of teeth on its two arcuate edges for gripping and tearing the articles; and a plurality of webs, each web mounted between the plates parallel with the straight edges for pushing the articles into the grinder chamber, the webs extending outward from the shaft in two directions 180° apart.

* * * * *